United States Patent [19]

Lindsay

[11] 3,937,166

[45] Feb. 10, 1976

[54] FLOAT CONNECTION ASSEMBLIES FOR MULTI-HULLED BOATS

[76] Inventor: Ian Lindsay, 122 Barton Road, Hawthorne, Queensland, Australia

[22] Filed: Oct. 7, 1974

[21] Appl. No.: 512,246

[30] Foreign Application Priority Data

Oct. 9, 1973 Australia ..... 5154/73

[52] U.S. Cl. ..... 114/123; 114/61

[51] Int. Cl.[2] ..... B63B 43/14

[58] Field of Search... 114/123, 39, 61, 122, 66.5 F; 9/2 R, 2 C, 2 F, 2 S; 115/22, 26

[56] References Cited

UNITED STATES PATENTS

| | | | |
|---|---|---|---|
| 2,678,018 | 5/1954 | Crisp | 114/123 |
| 2,917,754 | 12/1959 | Gunderson | 9/2 F |

FOREIGN PATENTS OR APPLICATIONS

| | | | |
|---|---|---|---|
| 553,899 | 6/1923 | France | 114/123 |
| 1,505,692 | 12/1967 | France | 114/66.5 F |

*Primary Examiner*—Trygve M. Blix
*Assistant Examiner*—Charles E. Frankfort
*Attorney, Agent, or Firm*—DeLio and Montgomery

[57] ABSTRACT

A multi-hulled boat includes a main float and a retractable float normally arranged, when in their operative positions, in spaced apart side-by-side relationship. A float connection assembly is provided, including a pivot structure interconnecting the main float and the retractable float and arranged so that the float connection assembly may be pivoted with respect to the main float to move the retractable float to lie alongside the main float. The arrangement is such that the pivotable float connection assembly includes a beam which can be connected rigidly to the main float and the retractable float.

9 Claims, 4 Drawing Figures

FLOAT CONNECTION ASSEMBLIES FOR MULTI-HULLED BOATS

This invention relates to float connection assemblies for multi-hulled boats, and in particular it relates to collapsible float connection assemblies for such boats to enable their overall beam to be reduced.

BACKGROUND OF THE INVENTION

Multi-hulled craft such as trimarans and catamarans, because of their relatively wide overall beam, have a disadvantage in that they are often too wide for transportation by road and also for berthing in marina pens and for manoeuvring in crowded anchorages. To overcome this disadvantage, especially in trimarans, many proposals have been devised to enable the floats to be selectively movable from an operative position where they are spaced outwardly from the main hull for maximum stability, to an inoperative position wherein the floats are moved inwards to lie adjacent the main hull to reduce the overall beam of the craft.

While this invention applies to catamarans and other two-hulled craft, it is particularly applicable to trimarans in which the accommodation is arranged in the central hull while the outer floats serve the main purpose of providing stability. In modern trimarans, the trend is to increased overall beam, therefore the loads on the beams interconnecting the floats with the main hull are increased.

With this trend to increased beams, floats of smaller proportions are being used and the floats are being kept as light as possible so as not to detract from the manoeuvrability of the trimaran. Thus, the floats are lightly constructed and are susceptible to damage, especially in confined areas where other craft are manoeuvring and collisions may occur. Additionally, because of their wide beam, multi-hulled boats which are built remote from launching sites are difficult to transport to their launching site, and it is advantageous if the floats can be removed or moved inwards to reduce the overall beam of the craft to enable it to be transported by normal road trailer.

To date, many proposals have been made to enable the overall beam of multi-hulled boats to be reduced. In some instances, the floats are simply bolted onto connecting beams and the craft may be dismantled for transportation. However, the floats must be reassembled before the boat is launched.

In another configuration, known as the "swing wing" configuration which has been used extensively on trimarans, the beams connecting the outrigger floats to the main hull are connected pivotally at their inner and outer ends to the main hull and floats respectively for pivotal movement about substantially parallel vertical axes. Two such beams are used per side and arranged to form a parallelogram arrangement so that the distance between the float and the main hull may be varied by pivoting the beams and there being provided means to retain the floats in their selected position.

While this method is reasonably successful, it imposes extremely high loads on the pivotal connections, especially those at the main hull. Furthermore, as these pivotal connections are exposed in a very corrosive sea-air atmosphere, their life expectancy and predictable serviceability leave much to be desired. Accordingly, there exists a great deal of resistance to such configurations because of the unavoidable weakness of the system. It will be appreciated that the ultimate loads imposed on the pivotal joints when multi-hulled craft are caught out in unusually rough conditions can be extremely high and failure of the float connections would have serious consequences. Thus, at present, most multi-hulled craft are built as a rigid unit, with their owners accepting the above disadvantages, mainly because of the lack of a suitable alternative.

Other arrangements for retracting floats of a trimaran have been proposed, but these suffer from the main disadvantage of an inherent weakness of hinged joints which are subjected to a corrosive atmosphere. Also, the prior proposals which simply arrange a pivot assembly in the connecting beams require the trimaran to be raised above the supporting surface, whether it be the water on which the boat floats or the ground, by a trailer or the like to enable the floats to swing down to their folded positions, because the floats in their folded position are disposed below the water line of the boat. If such craft have a very wide beam the floats in their folded attitude may extend below the bottom of the main hull. Another disadvantage with both fixed pivot arrangements, that is fixed pivots about vertical or horizontal axes, is that with fixed horizontal pivot axes folding of the floats increases the overall depth of the berth and with fixed vertical pivot axes, the overall length of the boat is increased because when the floats are swung to their folded attitude, the floats extend past the end of the main hull. Both such increases are a distinct disadvantage when trailing such craft.

It is, therefore, an object of this invention to provide a float connection assembly which will overcome the above and other disadvantages and which will be reliable and efficient in operation. In particular, it is an object of this invention to provide such connection assemblies in which the beams connecting the floats when in their operative disposition do not transfer the load only through hinged joints. Another object of this invention is to provide a float connection assembly for an outrigger type craft which will enable an outrigger float to be moved from its operative spaced position to its inoperative retracted position while the craft is floating and remains on an even keel. Other objects and advantages of the invention will become apparent from the following description.

SUMMARY OF THE INVENTION

With the foregoing and other objects in view, this invention resides broadly in a multi-hulled boat including a main float and a retractable float arranged, when in their operative extended attitude, in spaced apart side-by-side relationship and an above-water float connection assembly for maintaining the floats in their operative spaced apart attitude, said float connection assembly including a transversely extending beam connected at its outer end to said retractable float and having releasable connector means at its inner end enabling it to be releasably secured to said main float and a pivot assembly interconnecting said main float and said beam at a position intermediate its ends and adapted when said inner end is not secured operatively to said main float to guide said beam for pivotal movement about said main float in such manner that said retractable float may be retracted towards said main float to lie alongside the latter.

In order that the invention may be more readily understood and put into practical effect, reference will now be made to the accompanying drawings which illustrate a preferred embodiment of the invention and wherein.

Figure 1:
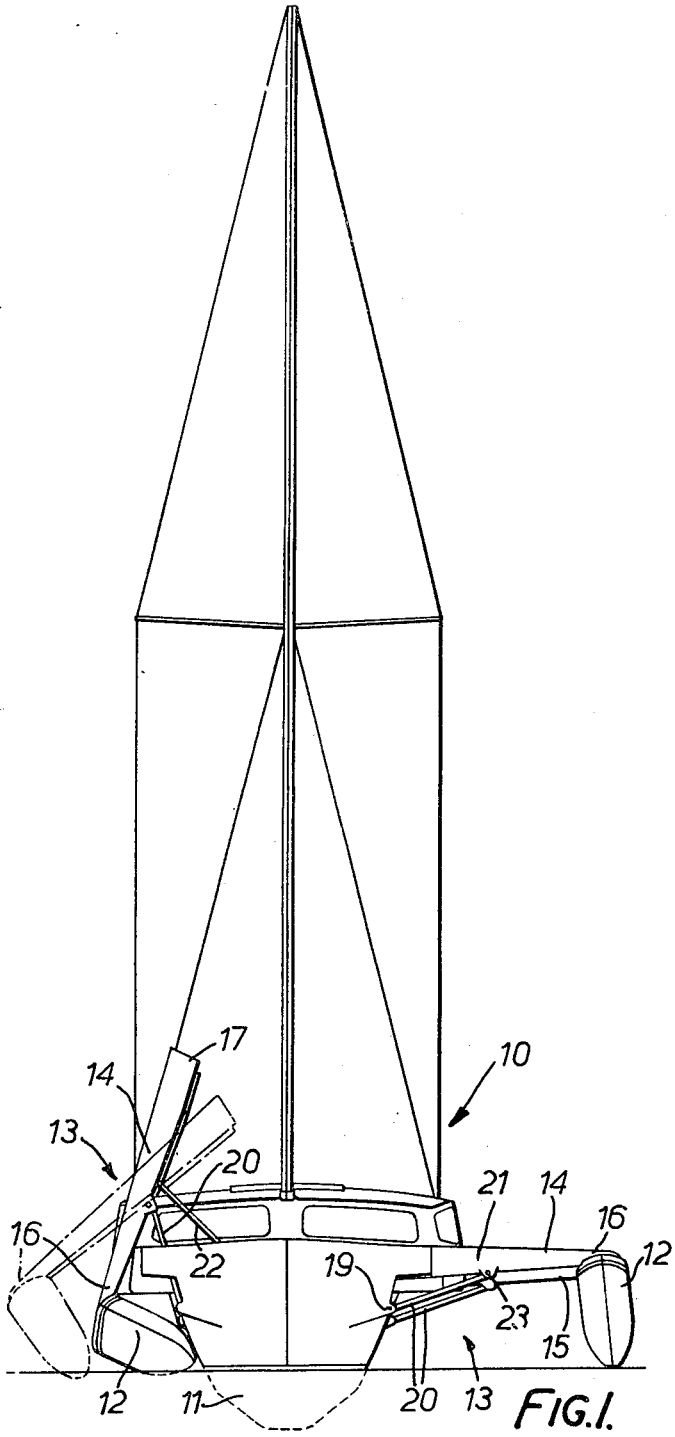
FIG. 1 is a front view of a trimaran having float connection assemblies in accordance with the present invention and illustrated with the starboard float in the retracted position.

Referring now to the drawings, there is shown a trimaran 10 including a main hull 11 and floats 12 arranged at opposite sides of the main hull 11. The floats 12 at each side of the main hull are each connected to the main hull by a pair of float connection assemblies 13 which, in this embodiment, include a pair of spaced apart beams 14 and 15 respectively, fixed rigidly at their outer ends 16 to the floats 12 and bolted removably at their inner ends 17 to the main hull 11 by bolts 18 passing through the inner ends 17 into suitable load bearing members rigid with the main hull 11.

While in this embodiment two float connection assemblies are provided per side, in some embodiments only one such float connection assembly need be provided, and to simplify description the construction of the float connection assembly will be hereinafter described with reference to one assembly only. As shown, the float connection assembly 13 includes a beam 14 and a support frame 20 connected pivotally at one end to the main hull at 19 for pivotal movement about a substantially longitudinal axis and pivotally at their outer ends at 23 to the mid portion 21 of the beam 14 for pivotal movement about an axis substantially parallel to the axis of the inner pivot. A further guide pivot frame 22 is connected pivotally to the main hull inwardly of the pivot 19 and pivotally to the beam 14 at 24 inwardly from the pivot 23.

Figure 3:
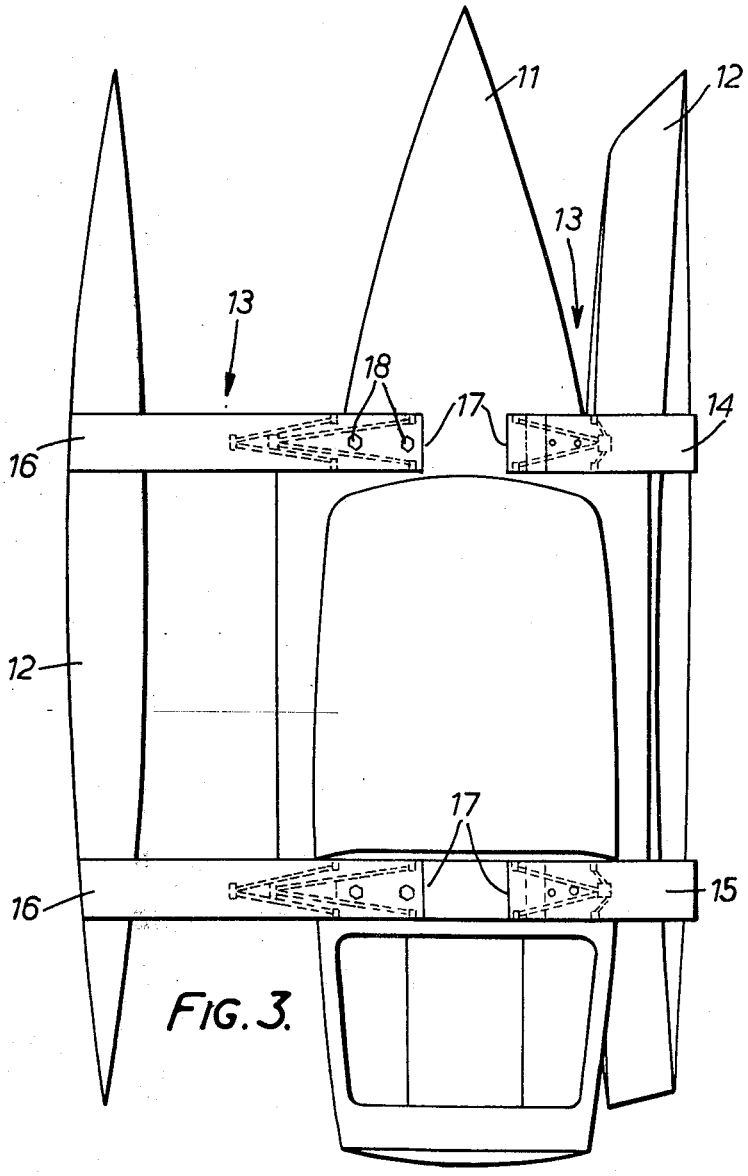
FIG. 3 is a plan view of the trimaran illustrated in FIG. 1.
Figure 2:
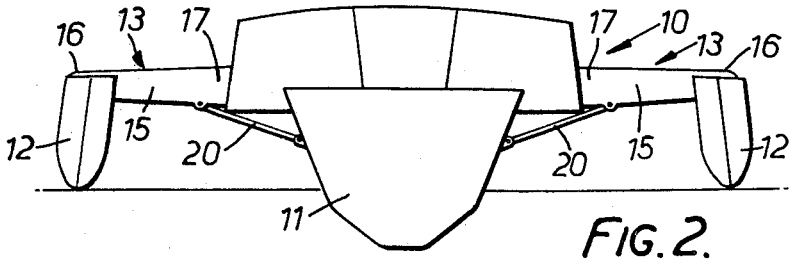
FIG. 2 is a rear view showing the trimaran with both floats in their operative position.
Figure 4:
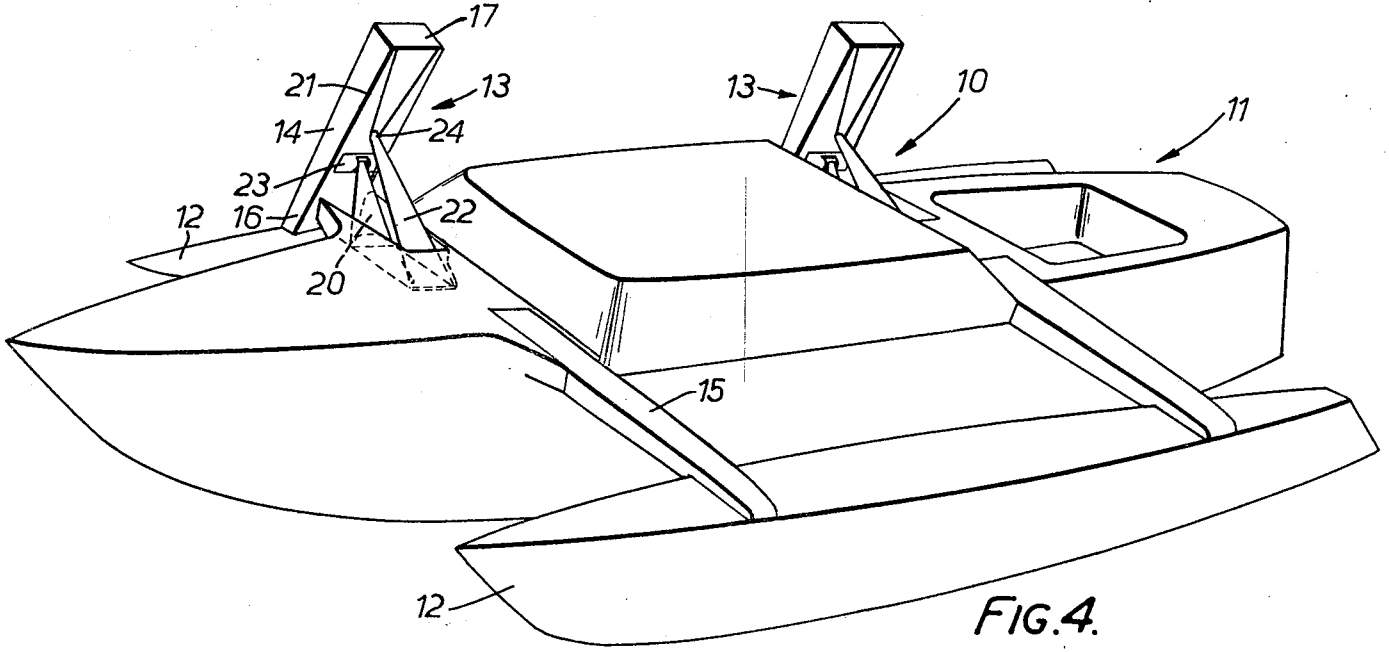
FIG. 4 is a perspective view showing the arrangement of a float connection assembly.

As shown in FIG. 1 and FIG. 3, after the bolts 18 connecting the inner end 17 of the beam 14 to the main hull 11 have been removed, the beam 14 may pivot, restrained by the support frame 20 and the guide frame 22. With the geometry as illustrated, the float 12 will move inwards as the arm 14 pivots upwards until the float 12 is positioned alongside of the main hull 11. It will also be seen that when moving from its operative extended position as shown by the port float, the starboard float will travel inwards in such manner that at all positions during its inward travel its effective displacement is not greatly varied, the main hull 11 therefore remains on an even keel. Thus, either or both floats may be moved from their operative extended position to the retracted position while the craft is in motion and with a minimum of effort.

Preferably there is provided a winch assembly located in the cockpit for handy operation by the helmsman and operatively associated with the float connection assembly to cause pivoting of the latter in either selected direction. In one form a continuous winch cable is used one end being connected to the support frame 20 and arranged so that it can pull the frame 20 upwards to retract the float and the other end being connected to the guide pivot frame 22 and arranged so that it can pull the frame 22 downwards to extend the float, and the cable between the ends passing about a suitable winch drum for retraction in either direction.

Also, in the preferred embodiment the winch operates simultaneously on all four connection assemblies so as to move the floats in unison with a single action of the winch assembly. The arrangement could also be such that the securing bolts 18 could be omitted, the beams 14 being retained in their selected position by the abovementioned winch assembly or by a hydraulic ram or the like. In this case, the support arms 20 would be utilized structurally as tension members.

However, normally the beams when in their operative extended position will be bolted rigidly to suitable load bearing members in the main hull so as to form a rigid structure with the main hull interconnecting the floats and the main hull. In this case, the support arms 20 would tend to rigidify the float connections and more effectively distribute the beam loads and rigging loads into the main hull. Also extensible hydraulic members may be incorporated to control the movement of the beams. Alternatively, a bracing beam could be provided, extending across the main hull and bolted rigidly at each end to the opposing beams to provide a continuous built-up beam extending across the boat from one retractable float to the other end connected rigidly to the main hull.

Furthermore, in the illustrated embodiment, in the event of a capsize, one float could be flooded and then winched towards its retracted position. This would tend to tilt the trimaran to a position where it may be possible to attach buoyancy to the mast head or take other actions to enable the boat to be reverted to its normal floating attitude.

While the above has been given by way of illustrative example it will, of course, be realised that many modifications of constructional detail and design may be made to the described embodiment and that the features of the invention may be utilized on other multi-hulled boats by persons skilled in the art without departing from the broad scope and ambit of the invention as is defined in the appended claims.

I claim:

1. A variable beam multi-hulled boat including a main float, a retractable stabilising float in spaced apart side-by-side relationship and an above-water float connection assembly adapted to maintain said floats in parallel side-by-side relationship, said assembly including a support beam fixed to said stabilising float and a pivot assembly connecting said support beam to said main float for pivotal movement with respect to said main float about a longitudinal axis to enable said stabilising float to be retracted towards said main float, and said pivot assembly including a pair of spaced guide frame assemblies each connected pivotally at opposite ends to said main float and to said support beam respectively for pivotal movement about respective spaced longitudinal axes and said guide frame assemblies being adapted to restrain said support beam for pivotal movement guiding said stabilising float for movement in a substantially horizontal direction towards said main float, to maintain a stabilising relationship with said main float at all times, and there being provided releasable locking means associated with said float connection assembly and operable to maintain said stabilizing float in its extended position.

2. A variable beam multi-hulled boat according to claim 1, wherein said support beam, when said stabilizing float is disposed in said extended position, extends transversely between said floats with its inner end remote from said stabilising float disposed in overlapping relationship with said main float and wherein said releasable locking means is associated with said inner end and operable to releasably secure said inner end to said main float.

3. A variable beam multi-hulled boat according to claim 2, wherein said inner end is adapted to be bolted rigidly to said main float, said bolted connection forming said releasable locking means.

4. A variable beam multi-hulled boat according to claim 2, wherein said pair of spaced guide frame assemblies comprises a lower guide frame assembly which extends upwards and outwards from a pivotal connection at the side of said main float to its pivotal connection with said support beam and an upper guide frame assembly positioned above said lower guide frame assembly and disposed with its pivotal connection to said support beam disposed inwardly of the pivotal connection between said support beam and said lower guide frame assembly.

5. A variable beam multi-hulled boat according to claim 4, wherein said main float and said stabilising float are connected together by a pair of said float connection assemblies disposed in spaced apart relationship longitudinally of said floats.

6. A variable beam multi-hulled boat according to claim 4 and in the form of a trimaran, wherein said main float constitutes a central float and said retractable stabilising float constitutes one of a pair of substantially identical retractable stabilising floats each disposed at a respective side of said central float and each stabilising float being connected to said central float by a said float connection assembly.

7. A trimaran according to claim 6, wherein said float connection assemblies of said stabilising floats are disposed in transverse alignment, whereby a transversely extending bracing beam may be connected rigidly to the respective support beams to form with said support beams a continuous built-up beam extending across said main float from one retractable stabilising float to the other retractable stabilising float.

8. A trimaran according to claim 6, wherein each said stabilising float is connected to said main float by a pair of said float connection assemblies disposed in spaced apart relationship longitudinally of said floats and wherein the front and rear float connection assemblies of one said pair are disposed in transverse alignment with the respective front and rear float connection assemblies of the other said pair.

9. A variable beam multi-hulled boat including a main float and a retractable stabilising float arranged, when in their extended position, in spaced apart side-by-side relationship and connected together by an above-water float connection assembly which includes a support beam fixed to said stabilising float and a pivot assembly connecting said support beam to said main float for pivotal movement with respect to said main float about a longitudinal axis to enable said stabilising float to be retracted towards said main float, and said pivot assembly being adapted to restrain said support beam for pivotal movement guiding said stabilising float for movement in a substantially horizontal direction towards said main float to maintain a stabilising relationship with said main float at all times and there being provided releasable locking means associated with said float connection assembly and operable to maintain said stabilizing float in its extended position.

* * * * *

UNITED STATES PATENT AND TRADEMARK OFFICE

CERTIFICATE OF CORRECTION

PATENT NO. : 3,937,166

DATED : February 10, 1976

INVENTOR(S) : Ian Lindsay Farrier

It is certified that error appears in the above-identified patent and that said Letters Patent are hereby corrected as shown below:

On the title page, the inventor's name should read, "Ian Lindsay Farrier".

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*